US008223090B2

(12) United States Patent
Kim

(10) Patent No.: US 8,223,090 B2
(45) Date of Patent: Jul. 17, 2012

(54) PLAMSA DISPLAY DEVICE AND METHOD FOR MANUFACTURING THE SAME

(75) Inventor: Ki-Dong Kim, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 1156 days.

(21) Appl. No.: 12/050,315

(22) Filed: Mar. 18, 2008

(65) Prior Publication Data

US 2008/0291128 A1 Nov. 27, 2008

(30) Foreign Application Priority Data

Mar. 21, 2007 (KR) ..... 10-2007-0027727

(51) Int. Cl.
*G09G 3/28* (2006.01)

(52) U.S. Cl. ..... 345/60; 245/204; 245/67; 313/582; 313/586; 315/169.4

(58) Field of Classification Search ..... 345/41, 345/60–68, 204; 315/169.4; 313/567, 582, 313/586

See application file for complete search history.

(56) References Cited

U.S. PATENT DOCUMENTS

| | | | | |
|---|---|---|---|---|
| 7,012,580 | B2 | 3/2006 | Mizobata | |
| 7,138,350 | B2 | 11/2006 | Sakurai et al. | |
| 7,710,351 | B2 * | 5/2010 | Sano et al. | 345/60 |
| 7,713,639 | B2 | 5/2010 | Lee et al. | |
| 2002/0044106 | A1 | 4/2002 | Iseki | |
| 2004/0131884 | A1 * | 7/2004 | Park et al. | 428/690 |
| 2004/0183441 | A1 | 9/2004 | Kim et al. | |
| 2004/0263733 | A1 | 12/2004 | Ito et al. | |
| 2006/0154801 | A1 | 7/2006 | Lee et al. | |

FOREIGN PATENT DOCUMENTS

| | | | |
|---|---|---|---|
| CN | 1821136 | A | 8/2006 |
| CN | 1855189 | A | 11/2006 |
| EP | 1 408 528 | | 4/2004 |
| EP | 1 482 068 | | 12/2004 |
| EP | 1 715 469 | A2 | 10/2006 |

(Continued)

OTHER PUBLICATIONS

Japanese Office Action dated Nov. 2, 2010 in Japanese Patent Application No. JP 2008-067759.

(Continued)

*Primary Examiner* — Lun-Yi Lao
*Assistant Examiner* — Sosina Abebe
(74) *Attorney, Agent, or Firm* — Knobbe Martens Olson & Bear, LLP

(57) ABSTRACT

A plasma display device is disclosed. The device includes a plasma display panel including an address electrode, first and second display electrodes crossing the address electrode, a dielectric layer covering the display electrodes, and an MgO protective layer covering the dielectric layer. The device also includes a driver configured to generate a sustain pulse width of 1 to 3.5 μs, and a statistical delay time (Ts) depending on temperature is represented by the following Formula 1:

$$y = A \times e^{-kx} \quad \text{(Formula 1)},$$

wherein k is a constant, x is 1/temperature, y is $1/T_s$, and A is a constant. The MgO protective layer may be formed by MgO deposition in which water vapor partial pressure is in a range of from $2\times10^{-7}$ to $6\times10^{-7}$ Torr·l/s. The temperature dependency of the discharge characteristics is reduced, response speed is improved, and the discharge stability is improved.

10 Claims, 5 Drawing Sheets

FOREIGN PATENT DOCUMENTS

| | | | |
|---|---|---|---|
| JP | 07-134565 | | 5/1995 |
| JP | 11-312469 | | 11/1999 |
| JP | 2004-198705 | A | 7/2004 |
| JP | 2005-50803 | | 2/2005 |
| JP | 2006-169636 | A | 6/2006 |
| JP | 2006-196461 | A | 7/2006 |
| JP | 2006-301571 | A | 11/2006 |
| JP | 2006-351555 | | 12/2006 |
| KR | 10-258913 | | 3/2000 |
| KR | 2001-91151 | | 10/2001 |
| KR | 2004-21190 | | 3/2004 |
| KR | 2004-32668 | | 4/2004 |
| KR | 2005-12472 | | 2/2005 |
| KR | 2005-39240 | | 4/2005 |
| KR | 2005-113685 | | 12/2005 |
| KR | 2006-80500 | | 7/2006 |

OTHER PUBLICATIONS

English Abstract for Korean Patent Application No. 1999-24358, Jun. 25, 1999.

U.S. Appl. No. 12/050,327, filed Mar. 18, 2008, Ki-Dong Kim, Samsung SDI Co., Ltd.

U.S. Appl. No. 12/050,332, filed Mar. 18, 2008, Ki-Dong Kim, Samsung SDI Co., Ltd.

U.S. Appl. No. 12/050,342, filed Mar. 18, 2008, Ki-Dong Kim, Samsung SDI Co., Ltd.

U.S. Appl. No. 12/050,356, filed Mar. 18, 2008, Ki-Dong Kim, Samsung SDI Co., Ltd.

Chinese Office Action dated Feb. 11, 2011 for Chinese Application No. CN 200810081991.5 which shares priority of Korean Patent Application No. KR 10-2007-0027727 with the captioned application.

Search Report issued by European Patent Office in European Patent Application No. 08251005.8-2208 on May 28, 2009.

Chinese Office Action dated Aug. 24, 2011 for Chinese Patent Application No. CN200810081991.5 which shares priority of Korean Patent Application KR 10-2007-0027727 with captioned U.S. Appl. No. 12/050,315.

* cited by examiner

PLAMSA DISPLAY DEVICE AND METHOD FOR MANUFACTURING THE SAME

CROSS-REFERENCE TO RELATED APPLICATIONS

This application claims the benefit of Korean Application No. 2007-27727, filed Mar. 21, 2007, in the Korean Intellectual Property Office, the disclosure of which is incorporated herein by reference.

BACKGROUND OF THE INVENTION

1. Field of the Invention

Aspects of the present invention relate to a plasma display device and a method of manufacturing the same. More particularly, aspects of the present invention relate to a plasma display device that has an improved response speed and discharge stability due to reduced discharge properties depending on temperature.

2. Description of the Related Art

A plasma display panel is a display device that forms an image by exciting phosphors with vacuum ultraviolet (VUV) rays generated by gas discharge in discharge cells. A plasma display panel displays text and/or graphics by using light emitted from plasma that is generated by the gas discharge. An image is formed by applying a predetermined level of voltage to two electrodes situated in a discharge space of the plasma display panel to induce plasma discharge between the two electrodes and exciting a phosphor layer that is formed in a predetermined pattern by ultraviolet rays generated from the plasma discharge. (The two electrodes situated in the discharge space of the plasma display panel are hereinafter referred to as the "display electrodes.")

Generally, the plasma display panel includes a dielectric layer that covers the two display electrodes and a protective layer on the dielectric layer to protect the dielectric layer. The protective layer is mainly composed of MgO, which is transparent to allow the visible light to permeate and which exhibits excellent protective performance for the dielectric layer and also produces secondary electron emission. Recently, however, alternatives and modifications to the MgO protective layer have been researched.

The MgO protective layer has a sputtering resistance characteristic that lessens the ionic impact of the discharge gas upon the display electrodes while the plasma display device is driven and protects the dielectric layer. Further, an MgO protective layer in the form of a transparent protective thin film reduces the discharge voltage by emitting secondary electrons. Typically, the MgO protective layer is coated on the dielectric layer in a thickness of 5000 to 9000 Å.

The components and membrane characteristics of the MgO protective layer significantly affect the discharge characteristics. The membrane characteristics of the MgO protective layer are significantly dependent upon the components and the coating conditions of deposition. It is desirable to develop optimal components and coating conditions for improving the membrane characteristics.

It is also desirable to improve the discharge stability of the high-definition plasma display panel (PDP) through an improvement of the response speed. The high-definition plasma display panel should respond to a rapid scan speed to establish a stable discharge in which all addressing is performed. The speed of the response to rapid scanning is determined by the formative delay time (Tf) and statistical delay time (Ts).

SUMMARY OF THE INVENTION

One embodiment of the present invention provides a plasma display device that has an improved response speed and discharge stability due to a reduced temperature dependency of discharge characteristics.

Another embodiment of the present invention provides a method of manufacturing the plasma display device.

According to an embodiment of the present invention, a plasma display device is provided that includes: a plasma display panel including an address electrode disposed on a first substrate, a pair of first and second display electrodes disposed on a second substrate and crossing the address electrode, a dielectric layer covering the first and second display electrodes on the second substrate, an MgO protective layer covering the dielectric layer on the second substrate, and discharge gases filled between the first and second substrates; a driver for driving the plasma display panel; and a controller for controlling the driver so that a sustain pulse width of a sustain period may be 1 to 3.5 μs. A statistical delay time depending on temperature is represented by the following Formula 1.

$$y=A\times e^{-kx} \qquad \text{Formula 1}$$

wherein k is a constant in a range of less than or equal to 2000 and a unit of the k is an absolute temperature (K), x is a reciprocal of the temperature (1/K), y is a reciprocal of a statistical delay time (Ts) (1/ns), and A is a constant ranging from $1\times10^{-6}$ to $1\times10^{6}$.

According to a non-limiting example, the k ranges from 0 to 1000. According to another non-limiting example, the k ranges from 0 to 500. According to a non-limiting example, the A ranges from $1\times10^{-3}$ to $1\times10^{3}$.

The sustain pulse width may be 1 to 3.5 μs. According to a non-limiting example, the sustain pulse width ranges from 1 to 3.0 μs.

The sustain period is 9 to 25 μs. According to a non-limiting example, the sustain period may be 10 to 25 μs.

The first sustain pulse width of the sustain period is less than or equal to 2 to 7.5 μs. According to a non-limiting example, the first sustain pulse width of the sustain period ranges from 2 to 7 μs.

The discharge gas includes 5 to 30 parts by volume of Xe based on 100 parts by volume of Ne. According to a non-limiting example, the discharge gas further includes 0 to 70 parts by volume of at least one gas selected from the group consisting of He, Ar, Kr, $O_2$, $N_2$, and combinations thereof, based on 100 parts by volume of Ne.

According to another embodiment of the present invention, a method is provided of manufacturing a plasma display device that includes forming a protective layer by MgO deposition. A water vapor is provided in a range of $2\times10^{-7}$ to $6\times10^{-7}$ Torr·l/s during the deposition.

According to one embodiment, the partial pressure of water vapor ranges from $2\times10^{-7}$ to $5\times10^{-7}$ Torr·l/s. According to another embodiment, the partial pressure of water vapor ranges from $2\times10^{-7}$ to $3\times10^{-7}$ Torr·l/s.

According to another embodiment, there is provided a method of manufacturing a plasma display panel of a plasma display device, comprising forming at least one pair of first and second display electrodes on a substrate; forming a dielectric layer to cover the at least one pair of first and second display electrodes; and forming an MgO protective layer on the dielectric layer by MgO deposition, wherein a water vapor is provided in a range of from $2\times10^{-7}$ to $6\times10^{-7}$ Torr·l/s during the MgO deposition.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
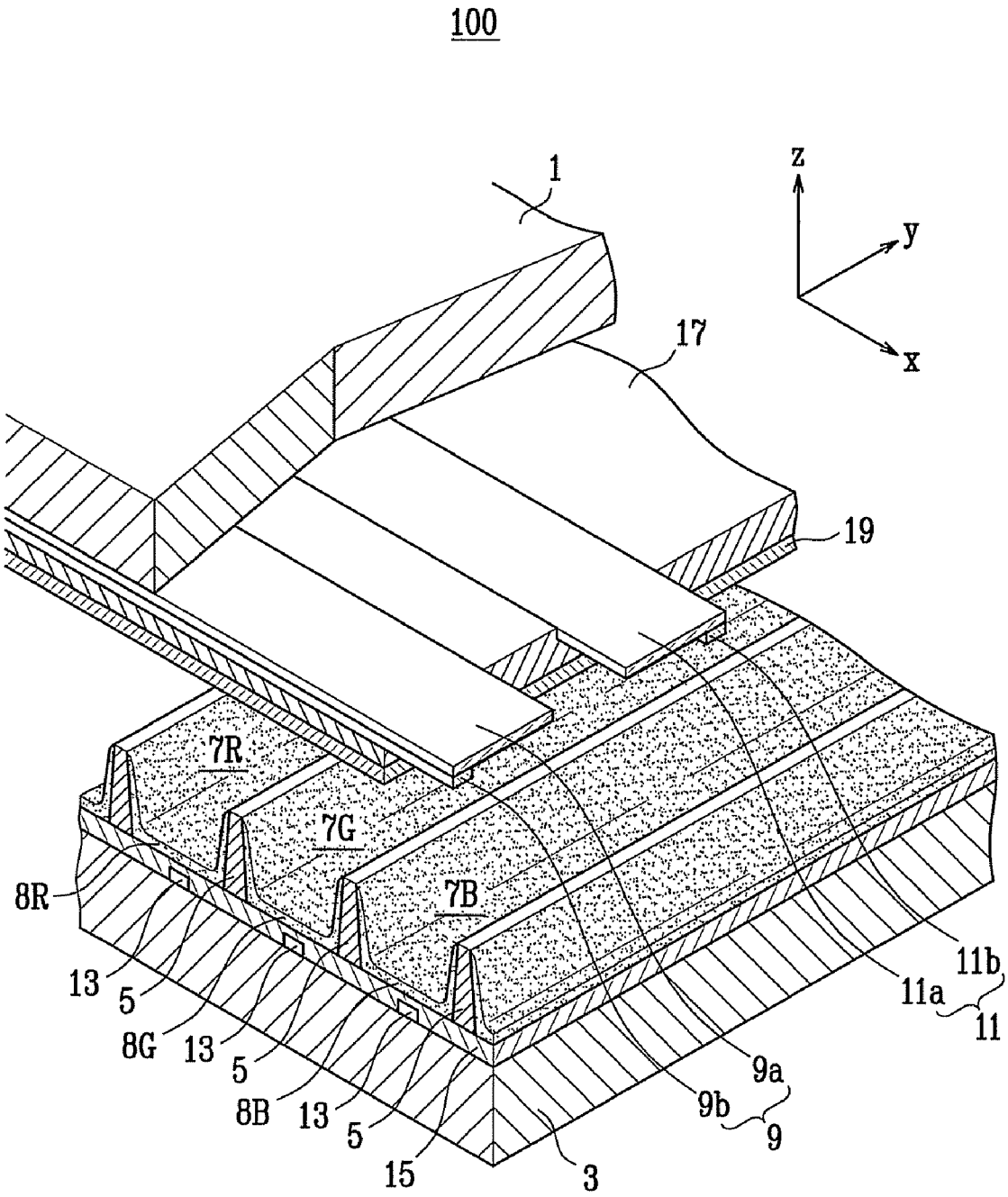
FIG. 1 is a partial exploded perspective view showing a structure of a plasma display panel according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Aspects of the present invention relate to an MgO protective layer that can improve the display quality of a plasma display device.

A plasma display device according to an embodiment of the present invention includes: a plasma display panel including an address electrode disposed on a first substrate, a pair of first and second display electrodes disposed on a second substrate and crossing the address electrode, a dielectric layer covering the first and second display electrodes on the second substrate, an MgO protective layer covering the dielectric layer on the second substrate, and discharge gases filled between the first and second substrates; a driver that drives the plasma display panel; and a controller that controls the driver so that a sustain pulse width of a sustain period may be 1 to 3.5 μs. A statistical delay time depending on temperature is represented by the following Formula 1.

$$y=A\times e^{-kx} \qquad \text{Formula 1}$$

wherein k is a constant in a range of less than or equal to 2000 and a unit of the k is an absolute temperature (K), x is an reciprocal of the temperature (1/K), y is an reciprocal of the statistical delay time ($T_s$) (1/ns), and A is a constant ranging from $1\times10^{-6}$ to $1\times10^{6}$. Herein, in general, when it is mentioned that one layer or material is formed on or covers a second layer or a second material, it is to be understood that the terms "formed on" and "covering" are not limited to the one layer being formed directly on the second layer, but may include instances wherein there is an intervening layer or material between the one layer and the second layer.

The sustain pulse width is 1 to 3.5 μs. According to a non-limiting example, the sustain pulse width is 1 to 3.0 μs. When the sustain pulse width is 1 to 3.5 μs, the high-definition plasma display device has an improved uniformity of images due to an improved discharge stability.

The sustain period is greater than or equal to 9 to 25 μs. According to a non-limiting example, the sustain period may be 10 to 25 μs. When the sustain period is 9 to 25 μs, the high-definition plasma display device has an improved uniformity of images due to an improved discharge stability.

The first sustain pulse width of the sustain period is 2 to 7.5 μs. According to a non-limiting example, the first sustain pulse width of the sustain period ranges from 2 to 7 μs.

When the first sustain pulse width of the sustain period is 2 to 7.5 μs, the high-definition plasma display device has an improved uniformity of images due to an improved discharge stability.

The discharge gas includes 5 to 30 parts by volume of Xe based on 100 parts by volume of Ne. According to a non-limiting example, the discharge gas includes 7 to 25 parts by volume of Xe based on 100 parts by volume of Ne. When the discharge gas includes Xe and Ne within the above ratio, the discharge initiation voltage is decreased due to an increased ionization ratio of the discharge gas. When the discharge initiation voltage is decreased, the high-definition plasma display device has a decreased power consumption and an increased brightness.

According to a non-limiting example, the discharge gas further includes 0 to 70 parts by volume of at least one gas selected from the group consisting of He, Ar, Kr, $O_2$, $N_2$, and combinations thereof based on 100 parts by volume of Ne. According to a specific, non-limiting example, the discharge gas includes 14 to 65 parts by volume of the gas selected from the group consisting of He, Ar, Kr, $O_2$, $N_2$, and combinations thereof based on 100 parts by volume of Ne. When the discharge gas includes at least one gas selected from the group consisting of He, Ar, Kr, $O_2$, $N_2$, and combinations thereof within the above ratio, the discharge initiation voltage is decreased due to an increased ionization ratio of the discharge gas. When the discharge initiation voltage is decreased, the high-definition plasma display device has decreased power consumption and an increased brightness.

An embodiment of the present invention will hereinafter be described in detail with reference to the accompanying drawings. As those skilled in the art would realize, the described embodiments may be modified in various different ways, all without departing from the spirit or scope of the present invention.

FIG. 1 is a partial exploded perspective view showing the structure of a plasma display panel according to one embodiment. Referring to the drawing, the PDP includes a first substrate 3, a plurality of address electrodes 13 disposed in one direction (a Y direction in the drawing) on the first substrate 3, and a first dielectric layer 15 disposed on the surface of the first substrate 3 covering the address electrodes 13. Barrier ribs 5 are formed on the first dielectric layer 15, and red (R), green (G), and blue (B) phosphor layers 8R, 8G, and 8B are disposed in discharge cells 7R, 7G, and 7B formed between the barrier ribs 5.

The barrier ribs 5 may be formed in any shape as long as their shape can partition the discharge space, and the barrier ribs 5 can have diverse patterns. For example, the barrier ribs 5 may be formed as an open type, such as stripes, or as a closed type, such as a waffle, matrix, or delta shape. As further non-limiting examples, closed-type barrier ribs may be formed such that a horizontal cross-section of the discharge space is a polygon, such as a quadrangle, triangle, or pentagon, or a circle or an oval.

Display electrodes 9 and 11, each including a pair of a transparent electrode 9*a* or 11*a* and a bus electrode 9*b* or 11*b*, are disposed in a direction crossing the address electrodes 13 (an X direction in the drawing) on one surface of a second substrate 1 facing the first substrate 3. Also, a second dielectric layer 17 and an MgO protective layer 19 are disposed on the surface of the second substrate 1 while covering the display electrodes.

The MgO protective layer 19 comprises MgO, and may further include one or more rare earth elements.

Discharge cells are formed at positions where the address electrodes 13 of the first substrate 3 are crossed by the display electrodes of the second substrate 1.

The discharge cells between the first substrate 3 and a second substrate 1 are filled with a discharge gas. The discharge gas includes 5 to 30 parts by volume of Xe based on 100 parts by volume of Ne. According to a non-limiting example, the discharge gas includes 7 to 25 parts by volume of Xe based on 100 parts by volume of Ne. The discharge gas may further include 0 to 70 parts by volume of at least one gas selected from the group consisting of He, Ar, Kr, $O_2$, $N_2$, and combinations thereof based on 100 parts by volume of Ne. According to another non-limiting example, the discharge gas includes 14 to 65 parts by volume of the gas based on 100 parts by volume of Ne.

Figure 2:
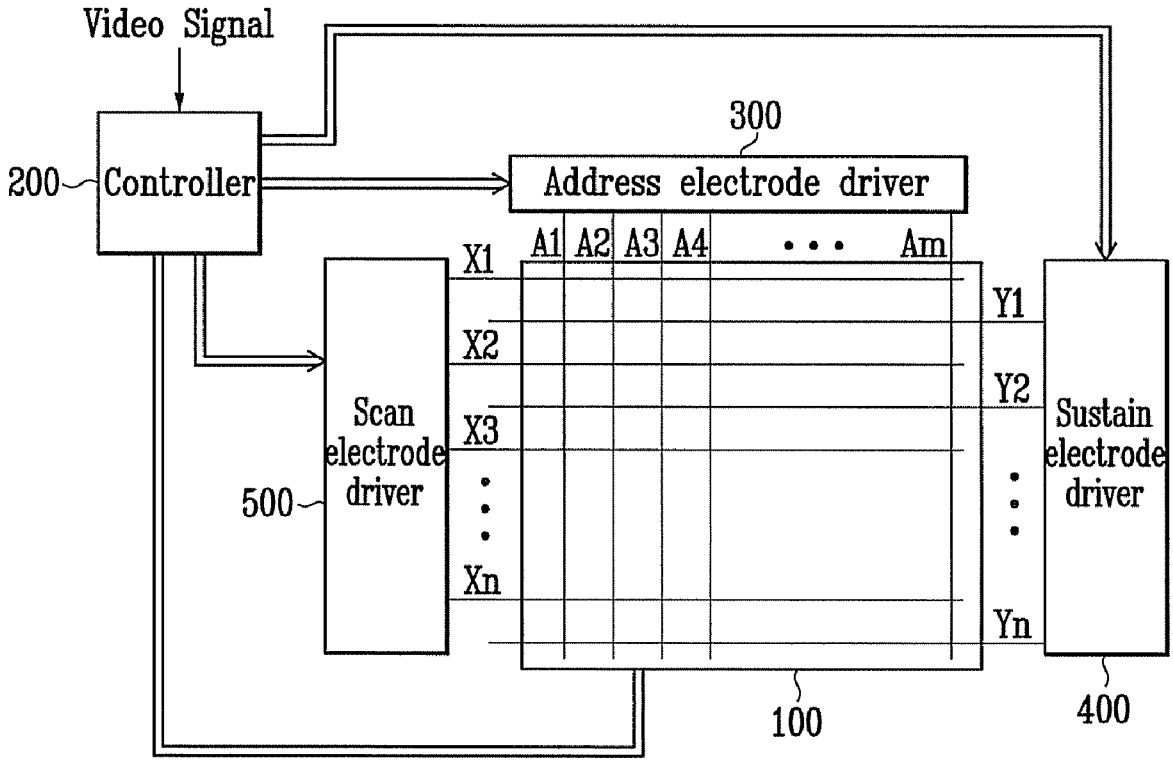
FIG. 2 is a schematic view showing a plasma display device that includes the plasma display panel of FIG. 1.

FIG. 2 is a schematic view showing a plasma display device according to an embodiment of the present invention. As shown in FIG. 2, the plasma display device according to one embodiment of the present invention includes a plasma display panel 100, a controller 200, an address electrode (A) driver 300, a sustain electrode (a second display electrode, X) driver 400, and a scan electrode (a first display electrode, Y) driver 500.

The plasma display panel 100 has the same structure as the plasma display panel 100 shown in FIG. 1.

The controller 200 receives video signals from the outside and outputs an address driving control signal, a sustain (X) electrode driving control signal, and a scan (Y) electrode driving control signal. The controller 200 divides one frame into a plurality of subfields. Each subfield is composed of a reset period, an address period, and a sustain period when the subfield is expressed based on a temporal driving change.

The address driver 300 receives an address (A) electrode driving control signal from a controller 200, and applies a display data signal to select a discharge cell to be displayed to each address electrode.

The sustain electrode driver 400 receives a sustain electrode driving control signal from the controller 200 and applies a driving voltage to the sustain electrodes X.

The scan electrode driver 500 receives a scan electrode driving control signal from the controller 200 and applies a driving voltage to the scan electrodes Y.

Figure 3:
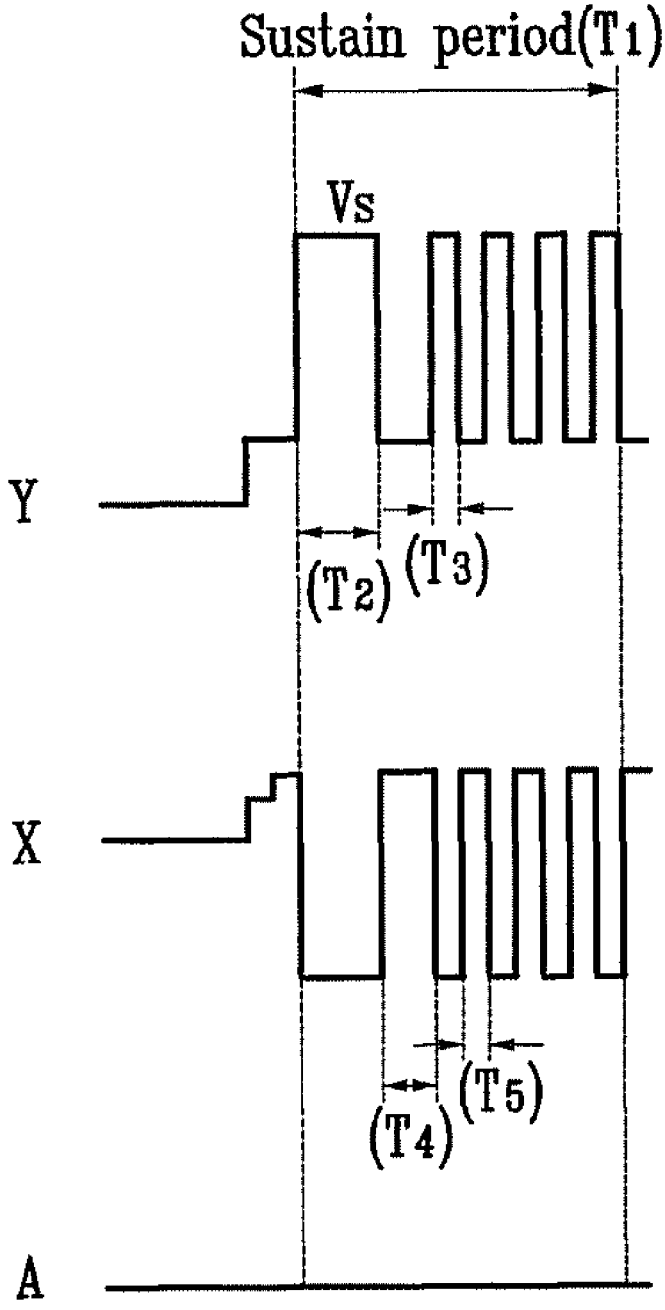
FIG. 3 shows a driving waveform of the plasma display device of FIG. 2.

FIG. 3 shows a driving waveform of the plasma display panel according to one embodiment of the present invention. As shown in FIG. 3, the first sustain discharge pulse of the Vs voltage at the sustain period ($T_1$) is applied to the scan electrode (Y) and the sustain electrode (X), alternately. If a wall voltage between the scan electrode (Y) and the sustain (X) electrode is generated, the scan (Y) electrode and the sustain (X) electrode are discharged by the wall voltage and the Vs voltage. Then, the applying of the scan (Y) electrode with the sustain discharge pulse of the Vs voltage and the applying of the sustain discharge pulse of the Vs voltage to the sustain (X) electrode are repeated a number of times corresponding to the weighted value indicated by the subfield.

Herein, the first sustain pulse width (T2) of the scan electrode (Y) or the first sustain discharge pulse width (T4) of the sustain period (X) is 2 to 7.5 μs. According to a non-limiting example, the first sustain pulse width (T2) of the scan electrode (Y) or the first sustain discharge pulse width (T4) of the sustain period (X) ranges from 2 to 7 μs. The sustain discharge pulse width (T3) of the scan electrode (Y) or the sustain discharge pulse width (T5) of the sustain electrode (X) is 1 to 3.5 μs. According to a non-limiting example, the sustain discharge pulse width (T3) of the scan electrode (Y) or the sustain discharge pulse width (T5) of the sustain electrode (X) ranges from 1 to 3.0 μs. The sustain period (T1) is greater than or equal to 9 to 25 μs. According to a non-limiting example, the sustain period (T1) ranges from 10 to 25 μs.

Aspects of the present invention provide driving stability to a plasma display device having the driving waveform and the discharge gas described above. In order to improve the discharge characteristic, when the change of the statistical delay time is represented by the following Formula 1, a plasma display device having a temperature k of 2000 or less is provided.

$$y = A \times e^{-kx} \qquad \text{Formula 1}$$

wherein k is a constant in a range of less than or equal to 2000 and a unit of the k is an absolute temperature (K), x is an reciprocal of the temperature (1/K), y is an reciprocal of a statistical delay time ($T_s$) (1/ns), and A is a constant ranging from $1\times10^{-6}$ to $1\times10^{6}$.

Preferably, k is 2000 or less when the change of the statistical delay time is represented by Formula 1. According to a non-limiting example, k ranges from 0 to 1000. According to yet another non-limiting example, k ranges from 0 to 500. Preferably, A ranges from $1\times10^{-6}$ to $1\times10^{6}$. According to a non-limiting example, A ranges from $1\times10^{-3}$ to $1\times10^{3}$.

When k is 2000 or less, the driving stability of the high-definition plasma display device having the driving waveform and the discharge gas is ensured because the statistical delay time is changed less in response to a temperature change. Accordingly, since k defines the conditions to generate the low discharge at a certain temperature, k can represent a type of activating energy.

The value of k is determined by measuring the statistical delay time depending upon the temperature, plotting the changes of the statistical delay time depending upon the numerical value on the x-axis that represents the reciprocal of the temperature and the numerical value on the y-axis that represents the reciprocal of the statistical delay time, and drawing a tendency line thereof using an exponential formula.

The range of k is adjusted by controlling the partial pressure of water vapor of the deposition atmosphere when the MgO protective layer is formed by vapor deposition. The partial pressure of water vapor may range from $2\times10^{-7}$ to $6\times10^{-7}$ Torr·l/s. According to a non-limiting example, the partial pressure of water vapor ranges from $2\times10^{-7}$ to $5\times10^{-7}$ Torr·l/s. According to another non-limiting example, the partial pressure of water vapor ranges from $2\times10^{-7}$ to $3\times10^{-7}$ Torr·l/s. The partial pressure of water vapor of the deposition atmosphere is a measure of gas flow.

When the MgO protective layer is formed by vapor deposition and the partial pressure water vapor of the deposition atmosphere is within the range described above, the value of k of the resultant plasma display device is 2000 or less.

The method of fabricating the plasma display device is well known to persons skilled in this art, so a detailed description thereof will be omitted from this specification. However, the process for forming the MgO protective layer according to one embodiment of the present invention will be described.

The MgO protective layer covers the surface of the dielectric layer in the plasma display device to protect the dielectric layer from the ionic impact of the discharge gas during the discharge. The MgO protective layer is mainly composed of MgO having sputtering-resistance and a high secondary electron emission coefficient.

The MgO protective layer of the present invention may be formed by a thick-layer printing method using a paste. However, a layer formed by thick-printing may have poor sputtering-resistance, and the secondary electron emission may be insufficient to decrease the discharge sustain voltage and the discharge initiation voltage. Therefore, the MgO protective layer is preferably formed by physical vapor deposition.

Herein, when the change of the statistical delay time is represented by Formula 1, the value of k can be controlled by changing the partial pressure of water vapor of the deposition atmosphere when the MgO protective layer is formed by vapor deposition.

$$y=A\times e^{-kx} \quad \text{Formula 1}$$

wherein k is a constant in a range of less than or equal to 2000 and a unit of the k is an absolute temperature (K), x is an reciprocal of the temperature (1/K), y is an reciprocal of a statistical delay time ($T_s$) (1/ns), and A is a constant ranging from $1\times10^{-6}$ to $1\times10^{6}$.

The partial pressure of water vapor ranges from $2\times10^{-7}$ to $6\times10^{-7}$ Torr·l/s. According to a non-limiting example, the partial pressure of water vapor ranges from $2\times10^{-7}$ to $5\times10^{-7}$ Torr·l/s. According to another non-limiting example, the partial pressure water vapor ranges from $2\times10^{-7}$ to $3\times10^{-7}$ Torr·l/s.

The MgO protective layer may be formed by a plasma deposition method, such as a method using electron beams, deposition beams, ion plating, or magnetron sputtering.

The depositing material for the MgO protective layer is formed into a pellet shape and fired. Since the pellet is decomposed depending upon the size and shape thereof, it is desirable to optimize the size and shape of the pellets.

Further, since the MgO protective layer contacts the discharge gas, the components and the membrane characteristics of the MgO protective layer significantly affect the discharge characteristics. The MgO protective layer characteristics are significantly dependent upon the components and the coating conditions during deposition. The coating conditions should be chosen such that the MgO protective layer has the required membrane characteristics.

The following examples illustrate the present invention in more detail. However, it is understood that the present invention is not limited by these examples.

Fabrication of Plasma Display Device

Example 1

Display electrodes having a stripe shape were formed on a soda lime glass substrate in accordance with a conventional process.

A glass paste was coated on the substrate formed with the display electrodes and fired to provide a second dielectric layer.

An MgO protective layer was provided on the second dielectric layer using an ion plating method to provide a second substrate. Herein, the partial pressure of water vapor of the deposition atmosphere was $2\times10^{-7}$ Torr·l/s during the MgO deposition. With the provided upper substrate, a plasma display device was fabricated. The sustain pulse width of a sustain period was 2.1 μs, the sustain period was 15 μs, and the first sustain pulse width of the sustain period was 2.1 μs. Also, the discharge gas included 11 parts by volume of Xe and 35 parts by volume of He based on 100 parts by volume of Ne.

Example 2

A plasma display device was fabricated in accordance with the same procedure as in Example 1, except that the partial pressure of water vapor of the deposition atmosphere was $3\times10^{-7}$ Torr·l/s during the MgO deposition.

Example 3

A plasma display device was fabricated in accordance with the same procedure as in Example 1, except that the partial pressure of water vapor of the deposition atmosphere was $4\times10^{-7}$ Torr·l/s during the MgO deposition.

Example 4

A plasma display device was fabricated in accordance with the same procedure as in Example 1, except that the partial pressure of water vapor of the deposition atmosphere was $5\times10^{-7}$ Torr·l/s during the MgO deposition.

Example 5

A plasma display device was fabricated in accordance with the same procedure as in Example 1, except that the partial pressure of water vapor of the deposition atmosphere was $6\times10^{-7}$ Torr·l/s during the MgO deposition.

Comparative Example 1

A plasma display device was fabricated in accordance with the same procedure as in Example 1, except that the partial pressure water vapor of the deposition atmosphere was $7\times10^{-7}$ Torr·l/s during the MgO deposition.

(Measurement for Statistical Delay Time of Plasma Display Device)

Figure 4:
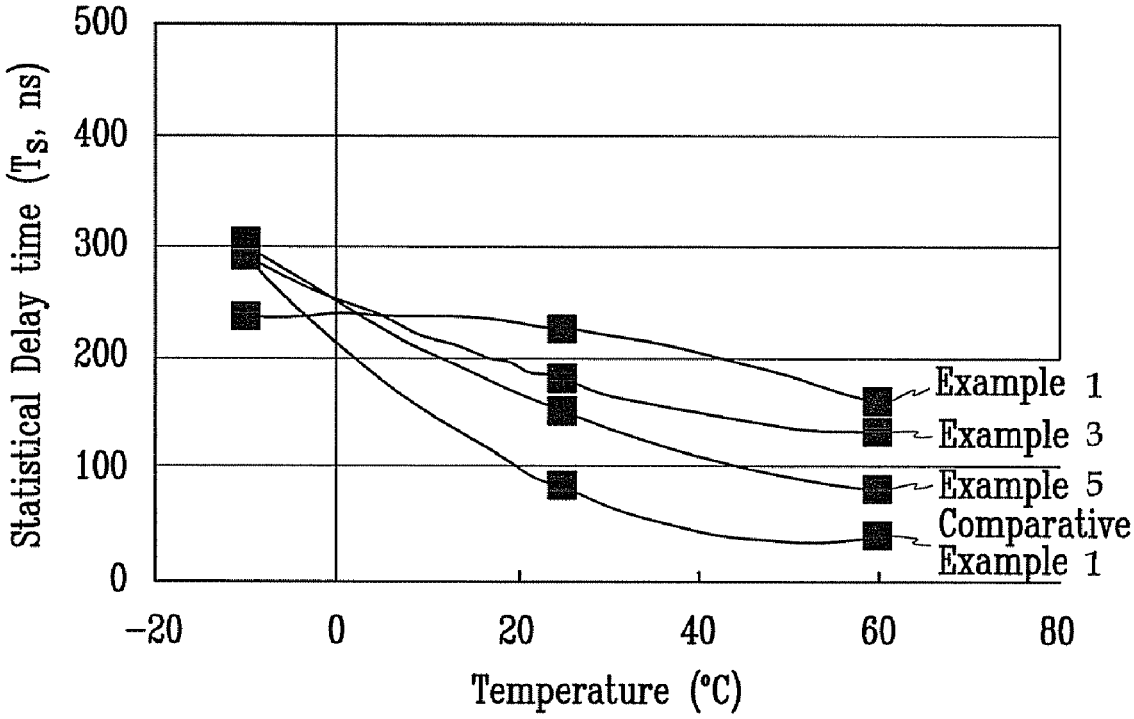
FIG. 4 is a graph showing a statistical delay time (Ts) depending on temperature of plasma display devices according to Examples 1, 3, and 5 and Comparative Example 1.

Plasma display devices according to Examples 1 to 5 and Comparative Example 1 were driven at a low temperature (−10° C.), room temperature (25° C.), and a high temperature (60° C.) to determine the statistical delay times (response speeds). The results are shown in FIG. 4. As shown in FIG. 4, the plasma display device according to Example 2 shows a similar result to that of Example 1, and the plasma display device according to Example 4 shows a similar result to that of Example 3.

Figure 5:
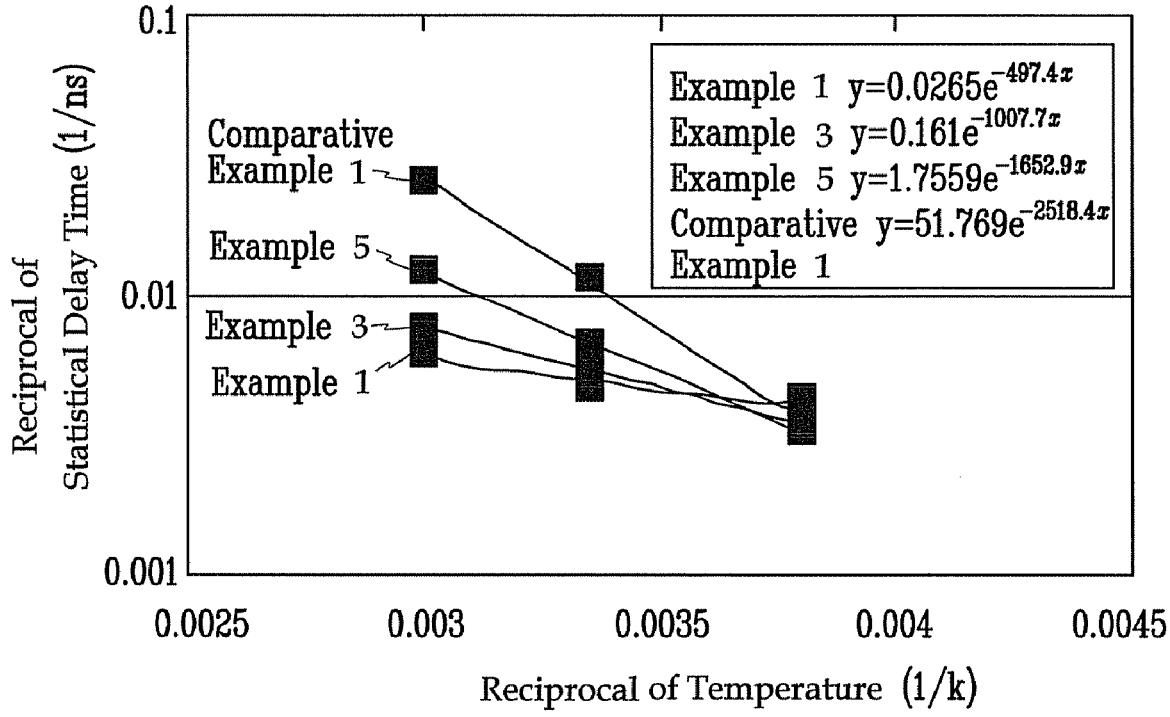
FIG. 5 is a graph showing the statistical delay time depending on the temperature in which the x-axis represents the reciprocal of the temperature and the y-axis represents the reciprocal of the statistical delay time.

FIG. 5 shows a plotted change of the statistical delay time depending on temperature, in which the x-axis represents the reciprocal of the temperature and the y-axis represents the reciprocal of the statistical delay time. In addition, FIG. 5 shows tendency lines thereof using exponential formulas.

As shown in FIG. 4, the statistical delay time for the plasma display device according to Comparative Example 1 is significantly dependent upon the temperature, and the plasma display device generates a low discharge at the high temperature of 60° C. On the other hand, the statistical delay time was less dependent upon the temperature with respect to the plasma display devices according to Examples 1, 3, and 5, and the discharge stability was improved. Further, there were no low discharge phenomena for the plasma display devices according to Examples 1, 3, and 5.

As shown in FIG. 5, the value of k was 497.4 for the plasma display device according to Example 1, the value of k was 1007.7 for the plasma display device according to Example 3, the value of k was 1652.9 for Example 5, and the value of k was 2518.4 for the plasma display device according to Comparative Example 1. Accordingly, it is confirmed that the low discharge phenomenon was found when the k was more than 2000.

The plasma display device according to one embodiment of the present invention is capable of decreasing the temperature dependency of discharge characteristics, improving the response speed, and improving the discharge stability.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A plasma display device comprising: a plasma display panel including at least one pair of first and second display electrodes disposed on a substrate; a dielectric layer covering the at least one pair of first and second display electrodes; and an MgO protective layer covering the dielectric layer; a driver that drives the plasma display panel; and a controller that controls the driver so that a sustain pulse width of a sustain period is 1 to 3.5 μs, wherein a statistical delay time depending on temperature is represented by the following Formula 1:

$$y=A\times e^{-kx} \quad \text{Formula 1}$$

wherein k is a constant in a range of less than or equal to 2000 and a unit of the k is an absolute temperature (K), x is an reciprocal of the temperature (1/K), y is an reciprocal of a statistical delay time (Ts) (1/ns), and A is a constant ranging from $1\times10^{-6}$ to $1\times10^{6}$.

2. The plasma display device of claim 1, wherein k ranges from 0 to 1000.

3. The plasma display device of claim 1, wherein k ranges from 0 to 500.

4. The plasma display device of claim 1, wherein the sustain pulse width is 1 to 3.0 μs.

5. The plasma display device of claim 1, wherein the sustain period is 9 to 25 μs.

6. The plasma display device of claim 5, wherein the sustain period ranges from 10 to 25 μs.

7. The plasma display device of claim 1, wherein the first sustain pulse width of the sustain period is 2 to 7.5 μs.

8. The plasma display device of claim 7, wherein the first sustain pulse width of the sustain period is 2 to 7 μs.

9. The plasma display device of claim 1, wherein the plasma display panel further comprises a discharge gas including 5 to 30 parts by volume of Xe based on 100 parts by volume of Ne.

10. The plasma display device of claim 9, wherein the discharge gas further comprises more than 0 to 70 parts by volume of at least one gas selected from the group consisting of He, Ar, Kr, $O_2$, $N_2$, and combinations thereof based on 100 parts by volume of Ne.

* * * * *